US009414982B2

(12) United States Patent
Jackson

(10) Patent No.: US 9,414,982 B2
(45) Date of Patent: Aug. 16, 2016

(54) SURGERY TABLE APPARATUS

(71) Applicant: Roger P. Jackson, Prairie Village, KS (US)

(72) Inventor: Roger P. Jackson, Prairie Village, KS (US)

( * ) Notice: Subject to any disclaimer, the term of this patent is extended or adjusted under 35 U.S.C. 154(b) by 0 days.

(21) Appl. No.: 15/005,493

(22) Filed: Jan. 25, 2016

(65) Prior Publication Data

US 2016/0136027 A1 May 19, 2016

Related U.S. Application Data

(63) Continuation of application No. 14/195,326, filed on Mar. 3, 2014, which is a continuation of application No. 13/694,765, filed on Jan. 2, 2013, now Pat. No. 8,677,529, which is a continuation of application No. 13/317,397, filed on Oct. 17, 2011, now abandoned, which is a continuation of application No. 12/803,252, filed on Jun. 22, 2010, now abandoned, which is a continuation of application No. 12/288,516, filed on Oct. 20, 2008, now Pat. No. 7,739,762.

(60) Provisional application No. 60/960,933, filed on Oct. 22, 2007.

(51) Int. Cl.
*A61G 13/00* (2006.01)
*A61G 13/08* (2006.01)

(52) U.S. Cl.
CPC ..... *A61G 13/08* (2013.01); *A61G 13/0036* (2013.01); *A61G 2013/0054* (2013.01)

(58) Field of Classification Search
CPC ..... A61G 13/04; A61G 13/08
USPC ..... 5/600, 607, 610–613, 617–619, 624
See application file for complete search history.

(56) References Cited

U.S. PATENT DOCUMENTS

| | | | | |
|---|---|---|---|---|
| 377,377 | A | 2/1888 | Ferry | |
| 5,131,106 | A * | 7/1992 | Jackson | A61G 13/00 5/607 |
| 6,885,165 | B2 | 4/2005 | Henley et al. | |
| 9,186,291 | B2 | 11/2015 | Jackson et al. | |
| 9,198,817 | B2 | 12/2015 | Jackson | |
| 9,205,013 | B2 | 12/2015 | Jackson | |
| 2003/0145383 | A1 | 8/2003 | Schwaegerle | |
| 2004/0133983 | A1 * | 7/2004 | Newkirk | A61G 13/0036 5/624 |
| 2010/0037397 | A1 | 2/2010 | Wood | |
| 2012/0174319 | A1 | 7/2012 | Menkedick | |
| 2012/0246830 | A1 | 10/2012 | Hornbach | |
| 2013/0312188 | A1 | 11/2013 | Jackson | |
| 2015/0007391 | A1 | 1/2015 | Xu | |
| 2016/0000621 | A1 | 1/2016 | Jackson et al. | |

(Continued)

OTHER PUBLICATIONS

Australian Patent Examination Report No. 2, AU2014200274, dated Oct. 9, 2015.

(Continued)

*Primary Examiner* — Fredrick Conley
(74) *Attorney, Agent, or Firm* — Polsinelli PC

(57) ABSTRACT

A surgery table utilizing first and second sections which are hingedly attached to one another. First and second sections are also connected to supports apart from the hinged portion. An elevator moves one of the sections upwardly and downwardly at the support. The resultant position of the frame formed by the first and second sections may take the configuration of a flat surface or an upwardly or downwardly oriented "vee".

20 Claims, 4 Drawing Sheets

(56) References Cited

U.S. PATENT DOCUMENTS

| | | | |
|---|---|---|---|
| 2016/0000626 | A1 | 1/2016 | Jackson et al. |
| 2016/0000627 | A1 | 1/2016 | Jackson et al. |
| 2016/0000629 | A1 | 1/2016 | Jackson et al. |
| 2016/0008201 | A1 | 1/2016 | Jackson et al. |

OTHER PUBLICATIONS

European Examination Report, EP11798501.0, dated Nov. 12, 2015.
Japanese Final Rejection (English version), JP 2014-142074, dated Dec. 6, 2015.
Quayle Action, U.S. Appl. No. 14/792,216, dated Sep. 9, 2015.

* cited by examiner

SURGERY TABLE APPARATUS

CROSS REFERENCE TO RELATED APPLICATIONS

The present application is a continuation of U.S. application Ser. No. 14/195,326 filed Mar. 3, 2014, which application is a continuation of U.S. patent application Ser. No. 13/694,765, filed Jan. 2, 2013, now U.S. Pat. No. 8,677,529, which was a continuation of U.S. patent application Ser. No. 13/317,397, filed Oct. 17, 2011, abandoned. Application Ser. No. 13/317,397 was a continuation of U.S. patent application Ser. No. 12/803,252, filed Jun. 22, 2010, abandoned. Application Ser. No. 12/803,252 is a continuation of U.S. patent application Ser. No. 12/288,516, filed Oct. 20, 2008, now U.S. Pat. No. 7,739,762, issued Jun. 22, 2010, which claimed the benefit of U.S. Provisional Patent Application 60/960,933, filed Oct. 22, 2007, all of which are incorporated by reference herein.

BACKGROUND OF THE INVENTION

The present invention relates to a novel and useful surgery table.

Surgery practices require the support of a patient on a surgery table and the adjustment of the patient's body by movements that include tilting, raising and lowering. Also articulation of the patient's body, generally around the waist portion may be necessary in certain instances. In the past, such movements have been achieved by the use of supports such as pillows and pads that are placed beneath and around the patient by surgical workers.

In addition, specialized motor-driven surgery tables have been devised to create a multiplicity of positions of a supporting surface to orient the patient resting atop the same. For example, U.S. Pat. No. 6,634,043 describes a medical table which includes a head portion and a pair of foot columns, all of which are extendable and retractable between upper and lower positions for maneuvering a patient to achieve proper support.

U.S. Pat. No. 7,152,261 describes a modular support system which is usable for surgery in which a pair of supports are independently operated adjacent one another to provide a plurality of support position for a patient.

A surgery table which allows the articulation of a pair of sections in order to position a patient for surgery in a safe and efficient manner would be a notable advance in the medical field.

BRIEF SUMMARY OF THE INVENTION

In accordance with the present invention a novel and useful surgery table is herein provided.

The surgery of the present application includes a first section having a proximal end and a distal end. A second section is also included and possesses a proximal and distal end. The distal ends of the first and second sections are hingedly attached to one another to form a frame that supports a patient for carrying out surgical procedures.

A first support holds the proximal end of the first section. The first support also includes an elevator which allows the proximal end portion of the first section to move relative to the first support. A second support holds the proximal end of the second section and includes a pivot to allow the hinging of the first section relative to the second section upon movement of the elevator found in the first support.

A length compensation mechanism is also present in relation to the first section to provide an adjustment of the distance between the proximal portion of the first section relative to the first support. Such length compensation may take the form of a journaled shaft which is positioned intermediate the first section and the first support. Further, another hinge may lie between the journal and the first support to provide articulation as required.

An upper body support may also be formed on the frame formed by the first and second sections. Such upper body support may include a slidable platform which allows the gentle movement of the patient when the frame is hinged to form an angle between the first and second sections thereof. Such upper body support may take the form of a flattened member which is moved by a belt or a chain and sprocket mechanism.

Further, the surgery table of the present invention may include a roll drive which allows the tilting of the frame along an axis common to the first and second supports. Again, the roll drive permits the surgeon to perform medical procedures in a convenient and safe manner due to such positioning of the patient.

The frame, as well as the first and second supports, may be interlinked by a bar which provides stability and adjustability to the length of the surgery table. Wheels may also be provided on the first and second supports to allow the surgery table be easily moved from storage to an operating room and back again.

It may be apparent that a novel and useful surgery table has been hereinabove described.

It is therefore an object of the present invention to provide a surgery table which is capable of positioning a patient for surgery procedures in a variety of positions.

Another object of the present invention is to provide a surgery table which is capable of positioning a patient for surgical procedures which eliminates frictional dragging of the patient relative to the surgery table.

Another object of the present invention is to provide a surgery table which is capable of positioning a patient in an angulated position in order to allow a surgeon to perform back surgery.

Another object of the present invention is to provide a surgery table which is capable of positioning a patient in a variety of surgical positions through a motorized mechanism, thus maximizing patient comfort and safety.

A further object of the present invention is to provide a surgery table which permits the use of X-ray devices during surgical procedures.

Another object of the present invention is to provide a surgery table which eliminates pinch points on the patient while the patient is being maneuvered into surgical positions.

A further object of the present invention is to provide a surgery table which is simple, compact, and easy to use during positioning of a patient for surgical procedures.

Yet another object of the present invention is to provide a surgery table which effects harmonious translation of the patient's torso during intraoperative spinal flexion and extension.

Another object of the present invention is to provide a surgery table that includes mechanisms to prevent distraction and compression of the spine of a patient when such patient is positioned for surgical procedures.

Another object of the present invention is to provide a surgery table which supports the natural biomechanics of the spine.

A further object of the present invention is to provide a surgery table that improves surgical access and visualization at a surgical site.

Another object of the present invention is to provide a surgery table that facilitates closure during lumbar osteotomy surgery.

Yet another object of the present invention is to provide a surgery table that employs a two-part hinged structure to enhance prone supine, and lateral procedures.

A further object of the present invention is to provide a surgery table that reduces renal caval compression and minimizes epidural venous bleeding.

The invention possesses other objects and advantages especially as concerns particular characteristics and features thereof which will become apparent as specification continues.

Figure 1:
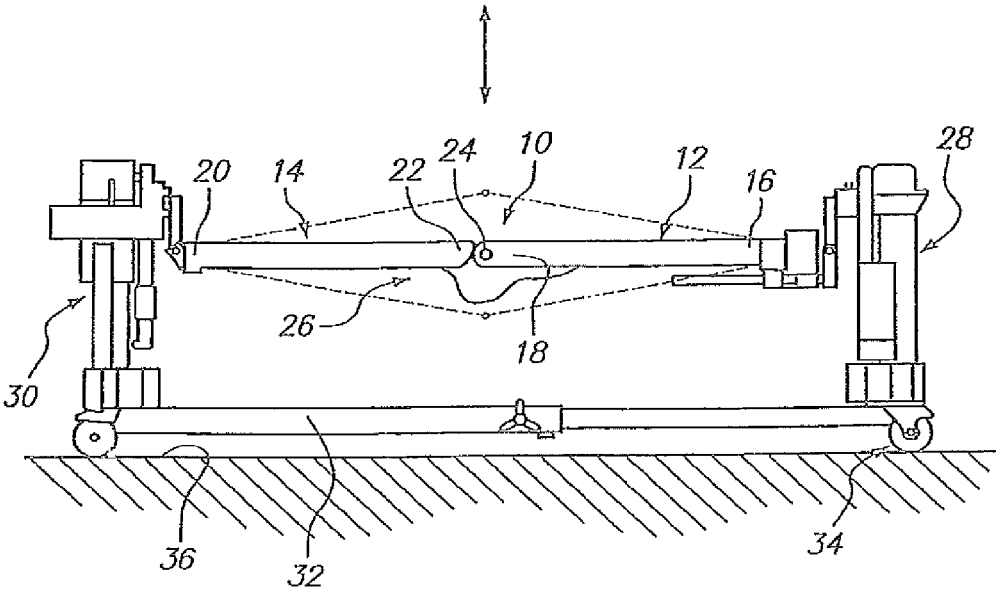
FIG. 1 is a side elevational view of the surgery table of the present invention.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

An embodiment of the invention as a whole shown in the drawings by reference character 10. Table 10 includes as two of its elements a first section 12 and a second section 14. First section 12 includes a proximal portion 16 and a distal portion 18. Likewise, second section 14 is provided with a proximal portion 20 and a distal portion 22. Hinge 24 rotatably connects distal portion 18 of first section 12 to distal portion 22 of second section 14, FIG. 1. First section 12, second section 14, and hinge 24 form a frame 26 which is intended to support a patient during surgery.

Again referring to FIG. 1, it may be observed that a first support 28 holds proximal portion 16 of first section 12, while a second support 30 holds proximal portion 20 of second section 14. Adjustable rod member 32 further stabilizes the interconnection between first support 28 and second support 30. Plurality of wheels 34 allow surgery table 10 to roll on a surface 36. Such mobility is necessary for storage and use of surgery table 12. Of course, wheels 34 may be locked into place while surgery table is used for medical procedures.

Figure 2:
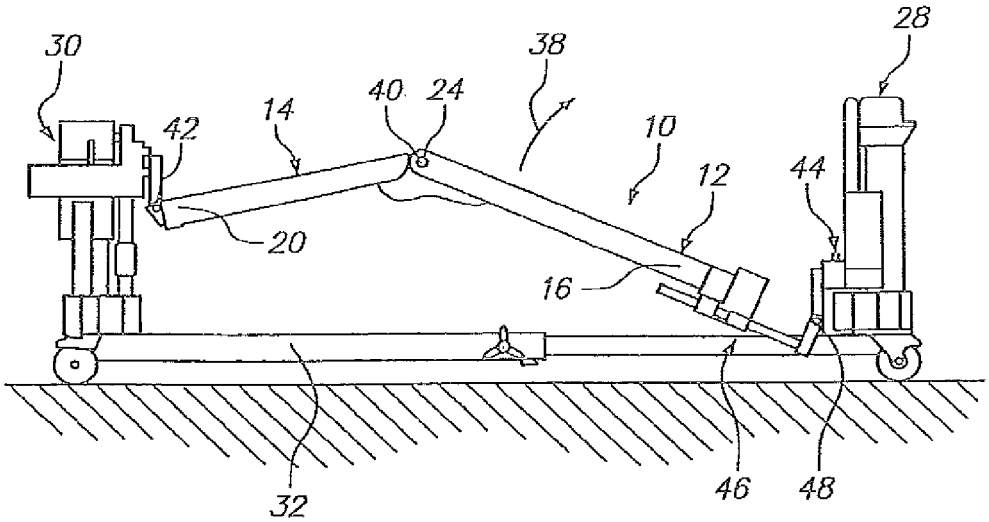
FIG. 2 is a side elevational view of the surgery table of the present invention angulated upwardly through its hinge mechanism to position a patient for back surgery.

Turning to FIG. 2, it may be seen that first section 12 has been rotated relative to second section 14, directional arrow 38. FIG. 1, depicts the up and down movement of distal ends 18 and 22 in phantom. During this operation, hinge 24 rotates about axis 40 and the proximal portion of second section 14 rotates about pivot 42. Additionally, an elevator 44 lowers the proximal portion 16 of first section 12. Adjustor 46, in the form of a journaled shaft, determines the distance between proximal portion 16 of first section 12 and support 28. Further, pivot 48 allows the rotation of a portion of adjustor 46 relative to elevator 44. Elevator 44 may be of known configuration, similar to one found in the Jackson surgery table distributed by Mizuho Orthopedic Systems Inc of Union City, Calif.

Figure 7:
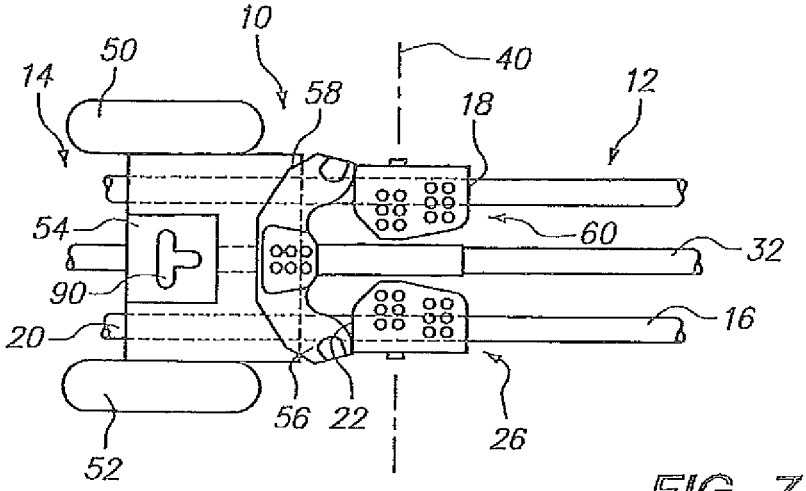
FIG. 7 is a partial top plan view of the surgery table of the FIG. 1 showing the face pad, chest pad, hip pads, and arm rests, and slidable platform.

With respect to FIG. 7, it may be apparent that surgery table 10 includes a number of patient support items. For example, arm rests 50 and 52 extend to second section 14 for support therefrom. Face support 54 and chest support 56 lie on a platform 58 which slides along second section 14 of frame 26, the details of which will be discussed hereinafter. Hip supports 60 position atop first section 12. Other pads atop frame 26 have not been shown for the sake of clarity.

Figure 3:
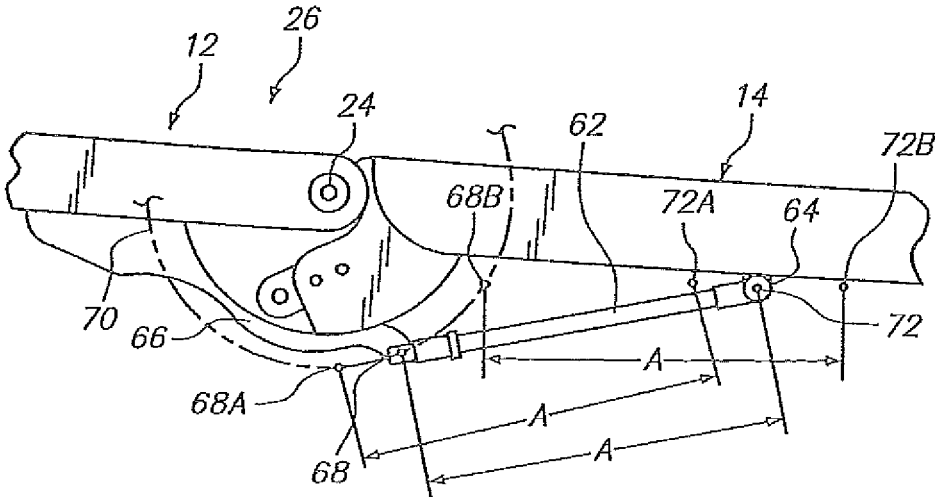
FIG. 3 is a partial side elevational view of the hinged portion of the table of the present invention, reversed in placement from FIGS. 1 and 2.

With reference to FIG. 3, it should be apparent that the hinged structure 24 of the table 10 is shown with portions of sections 12 and 14 shown on FIGS. 1 and 2. Hinge 24 is employed with a control rod 62 that is pivotally attached to tab 64 of first section 12 and to tab 66 of second section 14. When first and second sections 12 and 14 hinge downwardly, forming an upward vee, connection point 68 of control rod moves along arc 70 to a point 68A. At the same time, connection point 72 on the end of control rod at tab 64 moves to a point 72A Likewise, when sections 12 and 14 hinge upwardly to form an upside down vee, connection point 68 moves along are 70 to a position identified as 68B, while position point 72 relative to section 12 moves to a point shown as 72B. Most importantly, the distances between points 68 and 72, 68A and 72A, and 68B and 72B remain the same, being identified as distance "A", FIG. 3.

Figure 4:
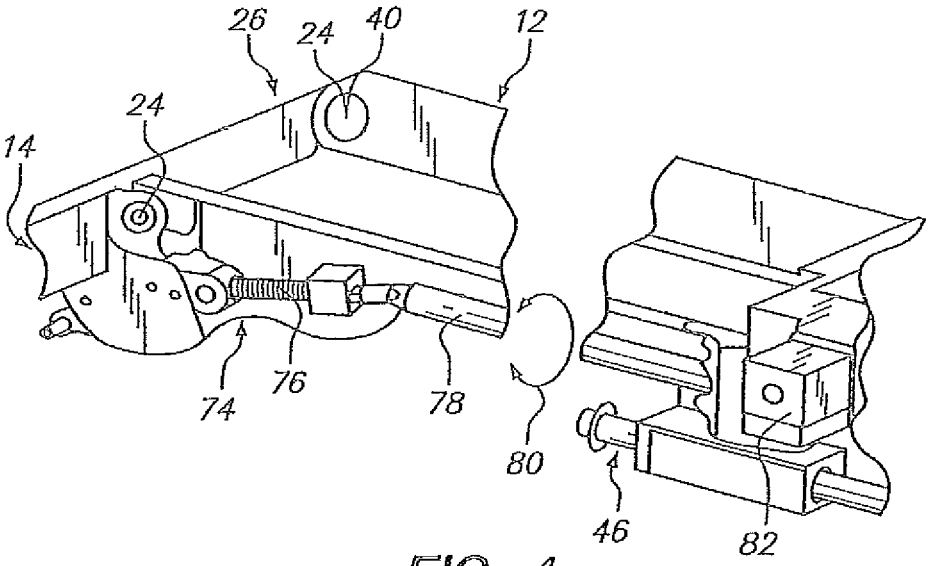
FIG. 4 is a broken perspective view of the hinge adjustment mechanism of the present invention.

Referring now to FIG. 4, it may be observed that the drive mechanism 74 is revealed in broken away configuration for the movement of sections 12 and 14. In essence, a lead screw 76 is rotated via link rod 78 according to directional arrow 80. Motor 82 provides the motivational force for such movement in a clockwise or a counter clockwise direction of link rod and lead screw 76. As depicted in FIG. 4, lead screw 76 has been turned to move frame 26 upwardly into an inverted vee position.

Figure 5:
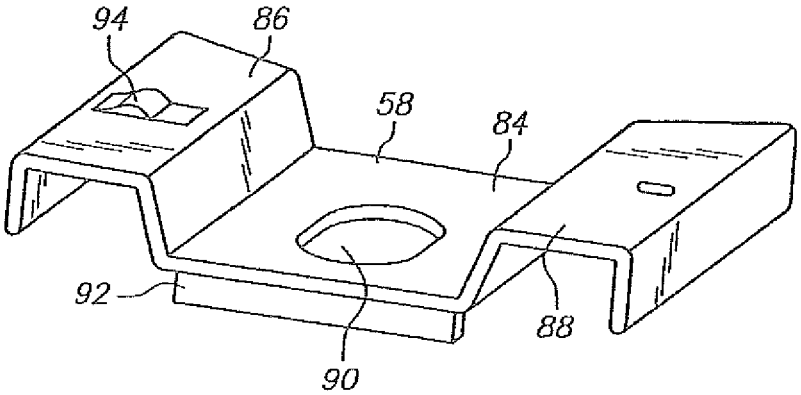
FIG. 5 is a top, front, right perspective view of the slidable platform for supporting the torso or chest of a patient used with the hinged sections of the table of the present invention.
Figure 6:
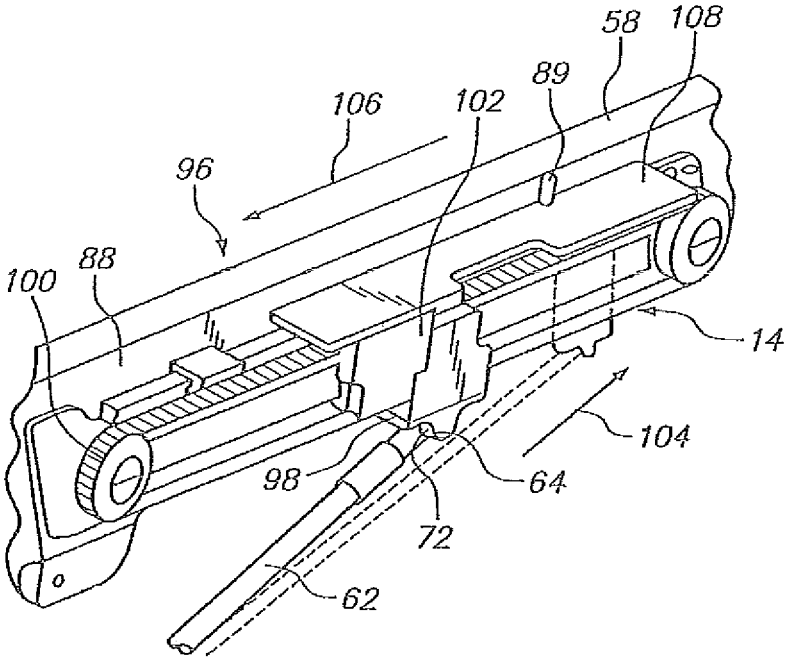
FIG. 6 is partial perspective view of the mechanism employed for sliding the torso platform of the present invention.

Turning now to FIGS. 5 and 6, it may be apparent that chest or torso sliding platform 58 is depicted. Platform 58 includes a central portion 84 and upwardly extending arms 86 and 88. Central opening 90 lies below the face of a patient when platform 58 is placed atop frame 26, FIG. 7. Plate 92 aides in the mounting of platform 58 to frame 26. Lock fixture 94 stabilizes platform 58 atop of frame 26.

FIG. 6, depicts the sliding mechanism 96 which moves platform 58 commensurate with the hinging of sections of 14 and 12 heretofore described. A plate 98, connected to control rod 62, captures a timing belt 100 in conjunction with a link 102. Thus, the movement of control rod connection point 72, directional arrow 104, moves belt 100 according to directional arrow 106. Needless to say, drive plate 108 also moves according to directional arrow 106 and is connected to sliding platform 58 at arm 88 via drive pin 89. In other words, the movement of connection point 72 of control rod 62 in one direction causes the movement of sliding platform 58 in the opposite direction.

Figure 8:
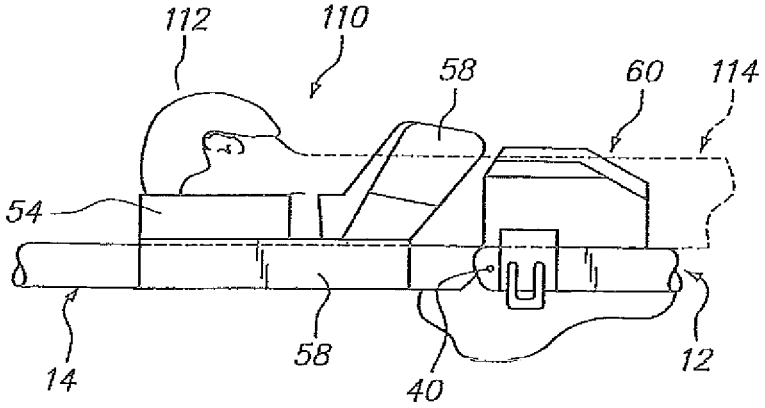
FIG. 8 is a schematic side elevational view of a portion of the surgery table of the present invention in which both sections are in the same plane.
Figure 9:
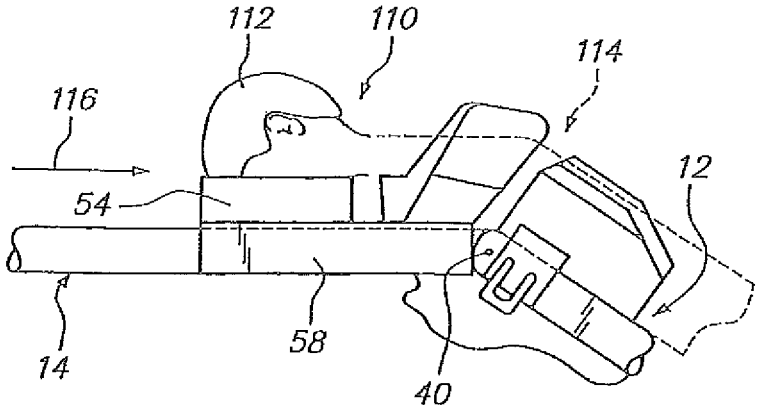
FIG. 9 is a side elevational view of a portion of the surgery table showing upward articulation of the same through its hinge mechanism and the movement of the face and torso support during such articulation.

In operation, referencing FIGS. 7-9, platform 58 is placed upon frame 26 and allowed to slide thereupon when sections 12 and 14 move about hinge 24 and around axis 40. In addition, face support 54, usually constructed of soft foam material, is positioned on sliding platform 58 above opening 90 chest support 56. Hip supports 60 are also placed as shown in FIG. 7. In addition, other pads may lie atop of frame 26 which are not depicted in order to reveal the mechanical mechanism of table 10. With reference to FIG. 8, it may be observed that a patient 110 has been placed on table 10 in a prone position. Head 112 lies atop of face support 54 while the remaining portion of patients body 114 extends toward first section 12 of frame 26. As shown in FIG. 8, the patient is generally in a level position. The hinging or movement of section 14 relative to section 12, FIG. 9, causes the upward movement of frame 26 in the formation of an inverted vee which allows patient 110 to be position appropriately for the conducting of operation procedures such as back surgery and the like. It should also be noted that sliding platform 58 and face support 54 has moved according to directional arrow 116 toward hinge axis 40 to prevent the frictional dragging of patient 110 relative to table 10. It should also be realized that patient 110 may be placed on table 10 laterally, in a supine position and the like. Of course, the hinging of table 10 about axis 40 would be accomplished in conjunction with such variations and positions of patient 110 pursuant to the surgical procedure taking place on patient 110. That is to say, distal portions 18 and 22 of first and second sections of frame 26 may raise or lower from a level position as required directional arrow 118, FIG. 2.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. A surgical table for supporting a patient having a torso region above a floor during a medical procedure, the apparatus comprising:

a patient support structure configured to support the patient during the medical procedure and comprising first and second sections that are inwardly coupled by a hinge and outwardly supported by respective first and second supports; and a chest platform configured to support the torso region of the patient, the chest platform being in sliding relation with the second section and coupled with the hinge through a motivating mechanism such that articulation of the first and second sections about the hinge into a flexed position causes the chest platform to move towards the hinge so as to increasingly position the patient in flexion.

2. The table of claim 1, further comprising hip supports positioned on the first section of the patient support structure.

3. The table of claim 1, wherein the hinge comprises a pair of spaced apart hinges.

4. The table of claim 1, wherein the patient support structure comprises only a single pair of spaced apart hinges between outer ends of the of the patient support structure.

5. The table of claim 1, wherein the first and second sections are open frame sections.

6. The table of claim 1, wherein the motivating mechanism causes the chest platform to move during the articulation.

7. The table of claim 1, wherein the motivating mechanism prevents free moving of the chest platform.

8. The table of claim 1, wherein the flexed position defines an angle under the first and second section of less than one hundred eighty degrees.

9. A surgical table for supporting a patient having a torso region above a floor during a medical procedure, the apparatus comprising:

a patient support structure consisting of first and second open frame sections and a hinge, the first and second frame sections coupled at outer ends to supports and coupled at inner ends to the hinge;

a chest platform slidingly engaged with the first open frame section and configured for receiving the torso region of the patient, wherein the chest platform is prevented from freely moving on the first open frame section by a motivating mechanism that is configured to move the chest platform towards the hinge when the first and second frame sections articulate about the hinge.

10. The table of claim 9, wherein the motivating mechanism is configured to move the chest platform towards the hinge when the first and second frame sections articulate about the hinge so as to increasingly position the patient in flexion.

11. The table of claim 10, wherein, when the patient is positioned in flexion, the first and second open frame sections define an upside-down vee with the hinges at an apex of the upside-down vee.

12. The table of claim 10, wherein, when the patient is positioned in flexion, an angle less than about one hundred eighty degrees is defined on an underside of the first and second open frame sections.

13. The table of claim 9, wherein the motivating mechanism is configured to move the chest platform towards the hinge when the first and second frame sections articulate about the hinge so as to increasingly position the first and second open frame sections in flexion.

14. The table of claim 9, wherein the hinge comprises a pair of spaced apart hinges.

15. A surgical table for supporting a patient having a torso region above a floor during a medical procedure, the apparatus comprising:

a patient support structure configured to support the patient during the medical procedure and comprising first and second sections that are inwardly coupled by a hinge and outwardly supported by respective first and second supports; and a chest platform configured to support the torso region of the patient, the chest platform being in slidable relation with the second section and cooperating with the hinge through a motivating mechanism such that articulation of the first and second sections about the hinge causes the chest platform to move in a predetermined controlled direction with respect to the hinge when positioning the patient thereon.

16. The table of claim 15, wherein the predetermined controlled direction is towards the hinge when the first and second sections articulate to position the patient lying prone in flexion.

17. The table of claim 15, wherein the motivating mechanism causes the chest platform to move during articulation.

18. The table of claim 15, wherein the motivating mechanism prevents free moving of the chest platform.

19. The table of claim 15, wherein the hinge comprises a pair of spaced apart hinges.

20. The table of claim 15, wherein the patient support structure comprises only a single pair of spaced apart hinges between outer ends of the of the patient support structure.

* * * * *